US011313585B2

(12) United States Patent
Kilic et al.

(10) Patent No.: US 11,313,585 B2
(45) Date of Patent: Apr. 26, 2022

(54) HEAT EXCHANGER

(71) Applicants: DAIKIN INDUSTRIES, LTD., Osaka (JP); DAIKIN EUROPE N.V., Ostend (BE)

(72) Inventors: Serhan M Kilic, Hendek (TR); Hakan Peker, Hendek (TR); Aydin Tuna, Hendek (TR)

(73) Assignees: Daikin Industries, Ltd., Osaka (JP); DAIKIN EUROPE N.V., Ostend (BE)

( * ) Notice: Subject to any disclaimer, the term of this patent is extended or adjusted under 35 U.S.C. 154(b) by 579 days.

(21) Appl. No.: 15/778,477

(22) PCT Filed: Nov. 22, 2016

(86) PCT No.: PCT/JP2016/084573
§ 371 (c)(1),
(2) Date: May 23, 2018

(87) PCT Pub. No.: WO2017/090593
PCT Pub. Date: Jun. 1, 2017

(65) Prior Publication Data

US 2020/0300503 A1 Sep. 24, 2020

(30) Foreign Application Priority Data

Nov. 25, 2015 (EP) ..... 15196276

(51) Int. Cl.
*F24H 1/10* (2022.01)
*F24H 1/14* (2022.01)
(Continued)

(52) U.S. Cl.
CPC ..... *F24H 1/107* (2013.01); *F24H 1/145* (2013.01); *F24H 1/38* (2013.01); *F28D 7/1692* (2013.01); *F28F 1/40* (2013.01)

(58) Field of Classification Search
CPC . F24H 1/107; F24H 1/145; F24H 1/38; F24H 9/00; F24H 1/26; F24H 1/24;
(Continued)

(56) References Cited

U.S. PATENT DOCUMENTS

2006/0250776 A1* 11/2006 Abul-Haj ..... F28F 3/02 361/710
2011/0108253 A1* 5/2011 Cool ..... F24H 1/52 165/151
2012/0090563 A1* 4/2012 Thijssen ..... B22C 7/065 122/367.1

FOREIGN PATENT DOCUMENTS

EP 0085470 A2 * 8/1983 ..... F24H 8/00
EP 0994313 A1 * 4/2000 ..... B22C 9/046
(Continued)

OTHER PUBLICATIONS

International Search Report of corresponding PCT Application No. PCT/JP2016/084573 dated Feb. 6, 2017.
(Continued)

*Primary Examiner* — Michael G Hoang
*Assistant Examiner* — Andrew W Cheung
(74) *Attorney, Agent, or Firm* — Global IP Counselors, LLP

(57) ABSTRACT

A heat exchanger includes front and rear walls forming a flue gas space such that a fluid flowing through a channel formed in the front and rear walls can exchange heat with flue gas in the flue gas space, in use. An entirety of the back wall extends along a first plane, and the back wall is provided with a back fin. The front wall includes a lower portion extending upwardly along the back wall, and an upper portion extending upwardly from an upper end of the lower portion and outwardly away from the back wall to form a combustion space of a flammable gas between the upper portion and the back wall. The upper portion is provided
(Continued)

with a front fin. The front and back fins are arranged symmetrically with respect to a virtual line along which the flammable gas is to be injected into the combustion space.

15 Claims, 9 Drawing Sheets

(51) Int. Cl.
*F24H 1/38* (2022.01)
*F28D 7/16* (2006.01)
*F28F 1/40* (2006.01)

(58) Field of Classification Search
CPC ... F24H 1/124; F24H 1/34; F24H 8/00; F24H 1/30; F24H 9/0026; F28D 7/1692; F28F 1/40; F28F 3/02; F28F 3/12; F28F 3/04; F28F 2250/04; B21D 53/02
USPC ..... 122/18.4
See application file for complete search history.

(56) References Cited

FOREIGN PATENT DOCUMENTS

| | | | | |
|---|---|---|---|---|
| EP | 1722172 | A1 * | 11/2006 | ..... F28F 3/022 |
| WO | 2009/053248 | A1 | 4/2009 | |
| WO | WO-2009053248 | A1 * | 4/2009 | ..... B22D 19/0063 |

OTHER PUBLICATIONS

European Search Report of corresponding EP Application No. 15 19 6276.8 dated Jun. 8, 2016.
International Preliminary Report of corresponding PCT Application No. PCT/JP2015/084573 dated Jun. 7, 2018.
International Preliminary Report of corresponding PCT Application No. PCT/JP2016/084573 dated Jun. 7, 2018.

* cited by examiner

HEAT EXCHANGER

CROSS-REFERENCE TO RELATED APPLICATIONS

This U.S. National stage application claims priority under 35 U.S.C. § 119(a) to European Patent Application No. 15196276.8, filed in EP on Nov. 25, 2015, the entire contents of which are hereby incorporated herein by reference.

BACKGROUND

Field of the Invention

The present invention relates to a heat exchanger, especially a heat exchanger in which heat is transferred from a flue gas to a flowing liquid.

Background Information

Such a heat exchanger is known from WO 2009/053248. This heat exchanger is provided with a front wall and a back wall. A combustion space is formed in the upper part of the space between the front wall and the back wall. Flammable gas is injected and combusted by a burner mounted on a top of the heat exchanger. Channels in which water flows are formed in the front wall and the back wall. Heat generated by gas combustion is transferred to water flowing in the channels. This heat exchanger has fins which extend from the front wall and the back wall into the combustion space for improving the heat exchange efficiency between the water and the flue gas. The walls are arranged symmetrically with respect to the center line in side view. The fins extending from walls are also arranged symmetrically with respect to the center line axis in side view.

SUMMARY

The known heat exchanger mentioned above has a certain efficiency in heat exchange with a relatively compact size. However, further improvement is required in both aspects of heat exchange efficiency and downsizing of the system equipped with the heat exchanger.

In view of this, present invention provides a heat exchanger which contributes to the miniaturization of the system equipped with the heat exchanger while maintaining heat exchange efficiency.

A first aspect of the present invention provides a heat exchanger comprising a front wall and a back wall to form a space for a flue gas such that a fluid flowing through a channel formed in the front wall and back wall can exchange heat with the flue gas, in use. The entire back wall extends along a first plane. The back wall is provided with a back fin. The front wall includes a lower portion and an upper portion. The lower portion extends upwardly along the back wall. The upper portion extends upwardly from the upper end of the lower portion. The upper portion extends outwardly away from the back wall so as to form a combustion space of a flammable gas between the upper portion and the back wall. The upper portion is provided with a front fin. The front fin and the back fin are arranged symmetrically with respect to a virtual line along which the flammable gas is to be injected into the combustion space.

According to the configuration above, since the back wall extends along the first plane without extending outwardly, the heat exchanger is easily accommodated in a housing of a heat exchange system equipped with the heat exchanger without making a useless space. Appropriate combustion condition in the combustion space, where a flammable gas is injected and combusted, is maintained at the same time due to the symmetrical arrangement of the fins with respect to the virtual line.

When arranging the heat exchanger on a horizontal plane, it is easy to downsize the heat exchange system equipped with the heat exchanger since the entire back wall extends along the vertical plane. For example, when putting the heat exchange system in a box-like-shaped housing, a dead space between the back surface of the heat exchanger and the inner surface of the housing can be minimized.

According to another aspect of the heat exchanger mentioned above, the front fin and the back fin are formed to protrude from the inner surface of the front wall and the back wall, respectively.

With the above configuration, by arranging the front fin and the back fin on inner surface of the front and back walls respectively, the heat exchange efficiency is improved as the heat exchange area increases.

According to another aspect of any one of the heat exchangers mentioned above, the front wall is provided with a plurality of the front fins and the back wall is provided with a plurality of the back fins which respectively correspond to one of the front fins. At least a part of the front fins and the corresponding back fins include respectively a first portion and a second portion arranged above the first portion. The height of the second portion from the inner surface of the corresponding wall is smaller than the height of the first portion from the inner surface of the corresponding wall.

When fins are positioned closer to the burner, it is expected that more heat is transferred to the fin. However, if they are positioned too close to the burner, local overheating of the fins can occur and thereby the fins can be damaged at least partially.

In this aspect, due to the difference in height of the first portions and the second portions in the fins, efficient heat transfer is achieved while preventing the local overheating of the fins.

According to another aspect of any one of the heat exchangers mentioned above, the front wall are provided with a plurality of the front fins and the back wall are provided with a plurality of the back fins which respectively correspond to one of the front fins. At least part of the front fins and the corresponding back fins include respectively an inwardly bulged portion which bulges toward the virtual line and an outwardly curved portion which curves away from the virtual line. The outwardly curved portion is arranged below the inwardly bulged portion.

With the above configuration, as the fins include the inwardly bulging portion and the outwardly curved portion, efficient combustion in the combustion space is achieved while preventing the local overheating of the fins.

According to another aspect of any one of the heat exchangers with fins having the inwardly bulged portion and the outwardly curved portion mentioned above, the inwardly bulged portion and the outwardly curved portion are formed so as to keep a predetermined distance between a burner to be installed on the heat exchanger and each fin.

With the above configuration, furthermore efficient combustion in the combustion space is achieved while preventing the local overheating of the fins.

The predetermined distance depends on various factors such as the desired power of the burner and the material of the fins.

According to another aspect of any one of the heat exchangers mentioned above, the front wall are provided with a plurality of the front fins and the back wall are provided with a plurality of the back fins which respectively correspond to one of the front fins. At least a part of the front fins and the corresponding back fins have respectively a tapered portion where the height of the fin from the inner surface of the corresponding wall gradually decreases towards an upper end of the fin.

With the above configuration, an appropriate distance between a burner and the fins can be maintained and heat damage to the fins can be avoided while keeping the efficiency in transferring heat to the fins. Also, the fin tends to be cooled more efficiently by making the height of the fin from the wall shorter and heat damage to the fins can be further avoided.

More preferably, the tapered portion is formed so as to keep a predetermined distance between a burner to be installed in the heat exchanger and the fin.

According to another aspect of any one of the heat exchangers mentioned above, the front wall is provided with front pins. The front pins extend backwardly from the inner surface of the front wall. A part of the front pins are arranged at the upper portion of the front wall below the front fin. The rest of the front pins are arranged at the lower portion of the front wall.

With the above configuration, the heat exchange efficiency and the durability of the heat exchanger against the heat can be improved at the same time.

It is more efficient for heat exchanging to put pins on the inner surface of the front and back walls. On the other hand, if pins are located too close to the burner, the pins can be easily damaged by overheating. Therefore, it is preferable to arrange the fins on the part of the inner surfaces of the walls which are close to the burner. If pins are arranged instead of fins on the part of the inner surfaces of the walls which are close to the burner, maximum temperature of the heat exchanger in the joining point of the pins will be increased and melting risk will be increased accordingly. However, pins are preferably used than the fins from the viewpoint of heat exchange efficiency. In other words, fins are preferably arranged in the area close to the burner, and have a suitable length along the flammable gas flow direction.

If only the front fin is arranged on the inner surface of the upper portion, the lengths of the front fin and the upper portion are restricted. However, in this aspect, the length of each of the front fin and the upper portion can be independently adjusted. Thereby, the design of the heat exchanger has more flexibility to achieve high efficiency in heat exchanging as well as high durability against heat.

According to another aspect of any one of the heat exchangers with front pins mentioned above, the back wall is provided with back pins extending forwardly from the inner surface of the back wall. The front pins arranged at the lower portion are connected to the corresponding back pins.

In use, the temperature in the combustion space between the front wall and the back wall goes down as being distant from the burner. In this aspect, heat is more efficiently exchanged since the front pins arranged on the lower portion, which is low-temperature area relative to the upper portion, are connected to the back pins so as to increase the surface area on which heat is transferred.

According to another aspect of any one of the heat exchangers with front and back pins mentioned above, the front pins are arranged at the upper portion of the front wall so as to face to the corresponding back pins.

According to another aspect of any one of the heat exchangers with front pins connected to the corresponding back pins mentioned above, the front pins arranged at the upper portion of the front wall are formed so as to decrease the distances between the front pins and the corresponding back pins toward the downside.

With this configuration above, enough combustion space can be securely maintained between the front pins arranged at the upper portion and the corresponding back pins, since the distances between the front pins and the corresponding back pins are relatively large on the upside which is closer to the burner. Further, the heat exchange efficiency can be improved at the same time since the distances between the front pins and the corresponding back pins are relatively small on the downside.

According to another aspect of any one of the heat exchangers with front pins mentioned above, each pin has larger surface area per unit volume than each fin. The use of both pins and fins mentioned above can enhance the efficiency of heat exchanging by arranging pins and fins on the appropriate areas respectively.

DETAILED DESCRIPTION OF EMBODIMENT(S)

Preferred embodiments of the heat exchanger according to the present invention will be described with reference to the drawings.

It should be understood that the detailed explanation are provided merely for the purpose of explanation, and are in no way to be construed as limiting of the present invention. While the present invention will be described with reference to exemplary preferred embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention will be described herein with reference to preferred structures, materials and embodiments, the present invention is not intended to be limited to the particulars disclosed herein; rather, the present invention extends to all functionally equivalent structures, methods and uses, such as are within the scope of the appended claims.

Figure 1:
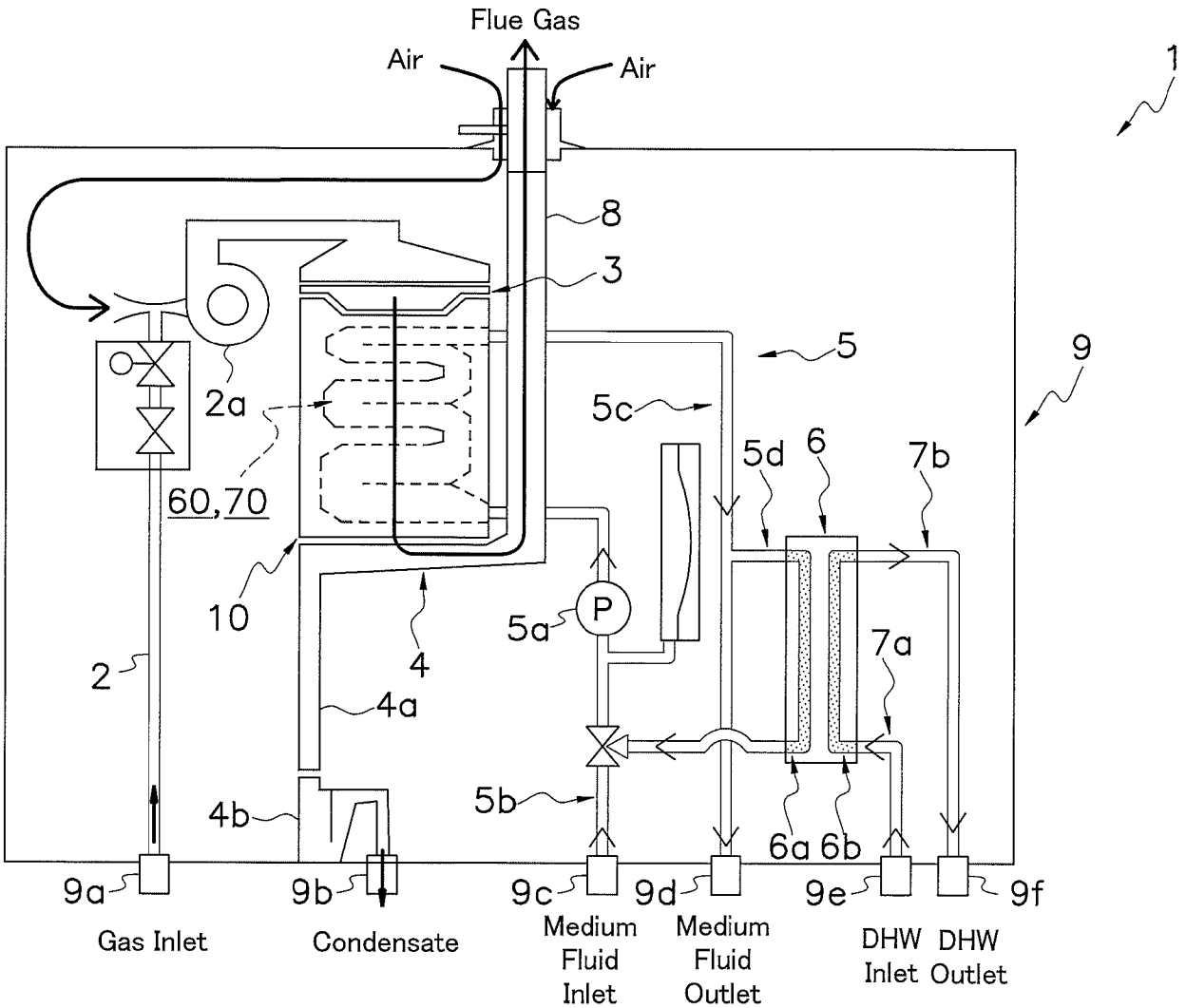
FIG. 1 is a schematic diagram of the heat exchange system equipped with the heat exchanger according to an embodiment of the present invention.

FIG. 1 shows a schematic diagram of a heat exchange system 1 equipped with a heat exchanger 10 according to a preferred embodiment of the present invention.

The heat exchange system 1 is used for heating medium fluid which is used for space heating and heating domestic water, while the heat exchange system 1 may be used only for heating the medium fluid for space heating or only for heating the domestic water.

As shown in FIG. 1, the heat exchange system 1 is mainly provided with the heat exchanger 10, a fan 2*a*, a burner 3, a siphon 4*b*, a pump 5*a*, a heat exchanger 6, and a housing 9. As shown in FIG. 1, the heat exchange system 1 has a gas inlet connector 9*a* to which a fuel gas supply pipe (not shown) is connected, a condensate outlet connector 9*b* to which a drain outlet pipe (not shown) is connected, medium fluid water inlet/outlet connectors 9*c*, 9*d* to which medium fluid inlet/outlet pipes (not shown) are respectively connected, and DHW (domestic heat water) inlet/outlet connectors 9*e*, 9*f* to which DHW inlet/outlet pipes (not shown) are respectively connected.

The housing 9 shown in FIG. 1 has a box-like-shape such as a cuboid shape. The housing 9 accommodates the heat exchanger 10, the fan 2*a*, the burner 3, the siphon 4*b*, the pump 5*a*, and the heat exchanger 6 as shown in FIG. 1.

The fan 2*a* intakes a fuel gas, such as natural gas, supplied from the fuel gas supply pipe (not shown) via the gas inlet connector 9*a* and a gas pipe 2 as shown in FIG. 1. The fan 2*a* also intakes air from the outside of the housing 9. The fan 2*a* then supplies the mixture gas with the fuel gas and the air to the burner 3.

Figure 3:
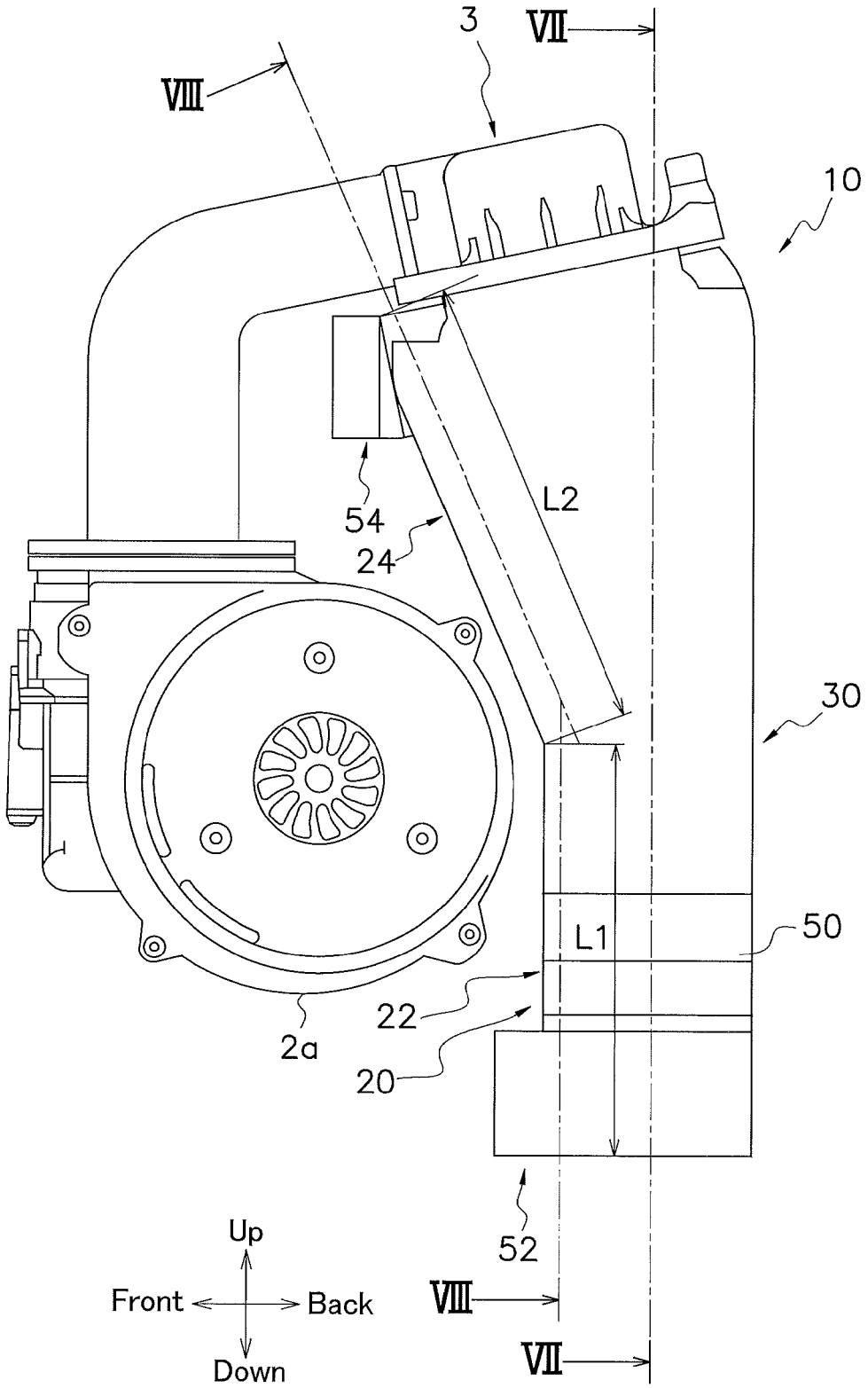
FIG. 3 is a side view of the heat exchanger on which the burner is mounted according to FIG. 1.

The burner 3 is mounted on the heat exchanger 10 as shown in FIG. 3.

Figure 6:
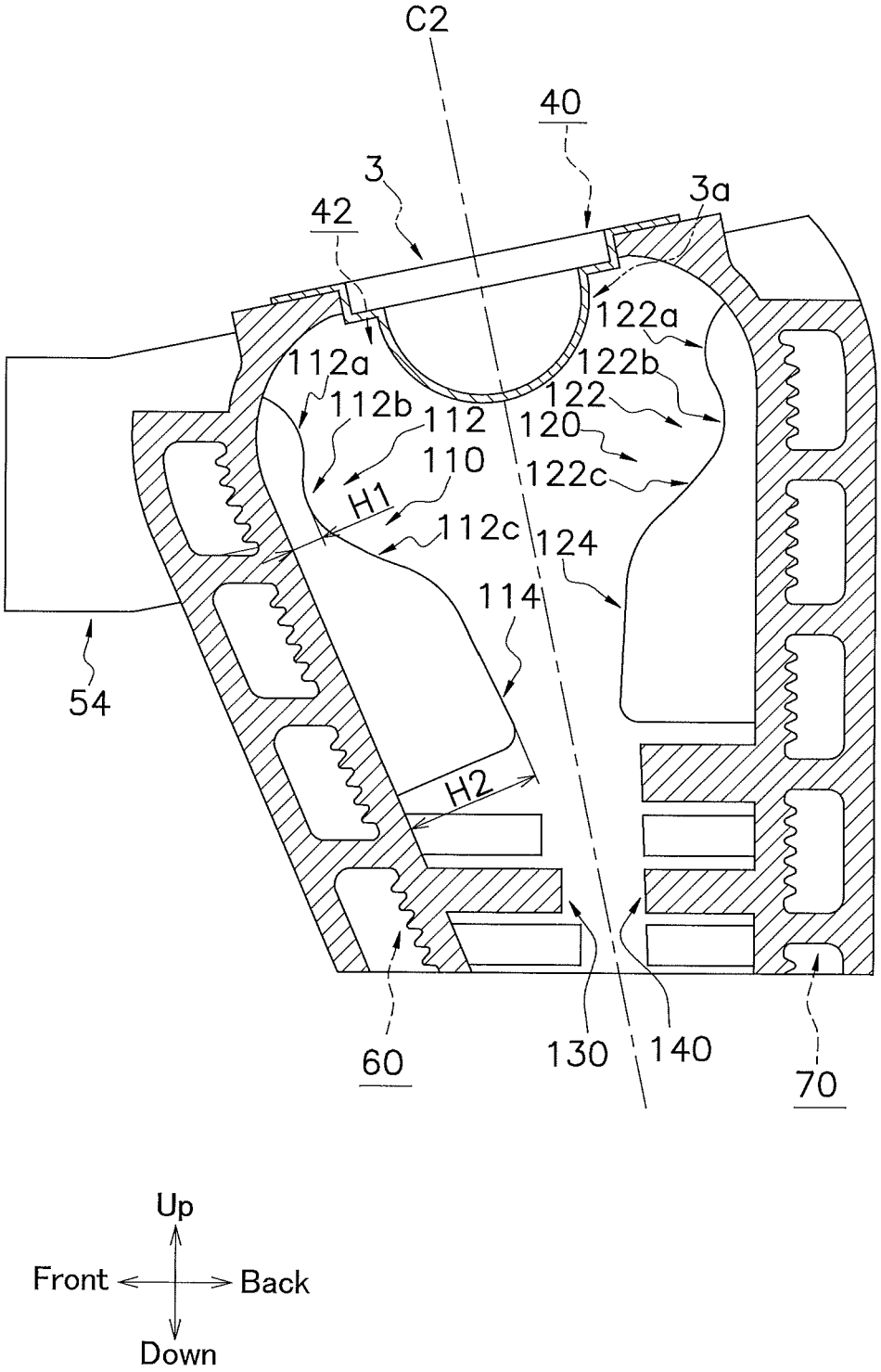
FIG. 6 is a cross section view of the heat exchanger viewing from the arrow direction of the VI-VI line of FIG. 4.

Specifically, the burner 3 is mounted on the top of the heat exchanger 10. A burner port 3*a* of the burner 3, from which flammable gas is injected, is arranged in a combustion space 42 formed in the heat exchanger 10 as shown in FIG. 6. The burner 3 injects the flammable gas (mixture gas with the fuel gas and the air) into the combustion space 42 and combusts the flammable gas in the combustion space 42.

Figure 5:
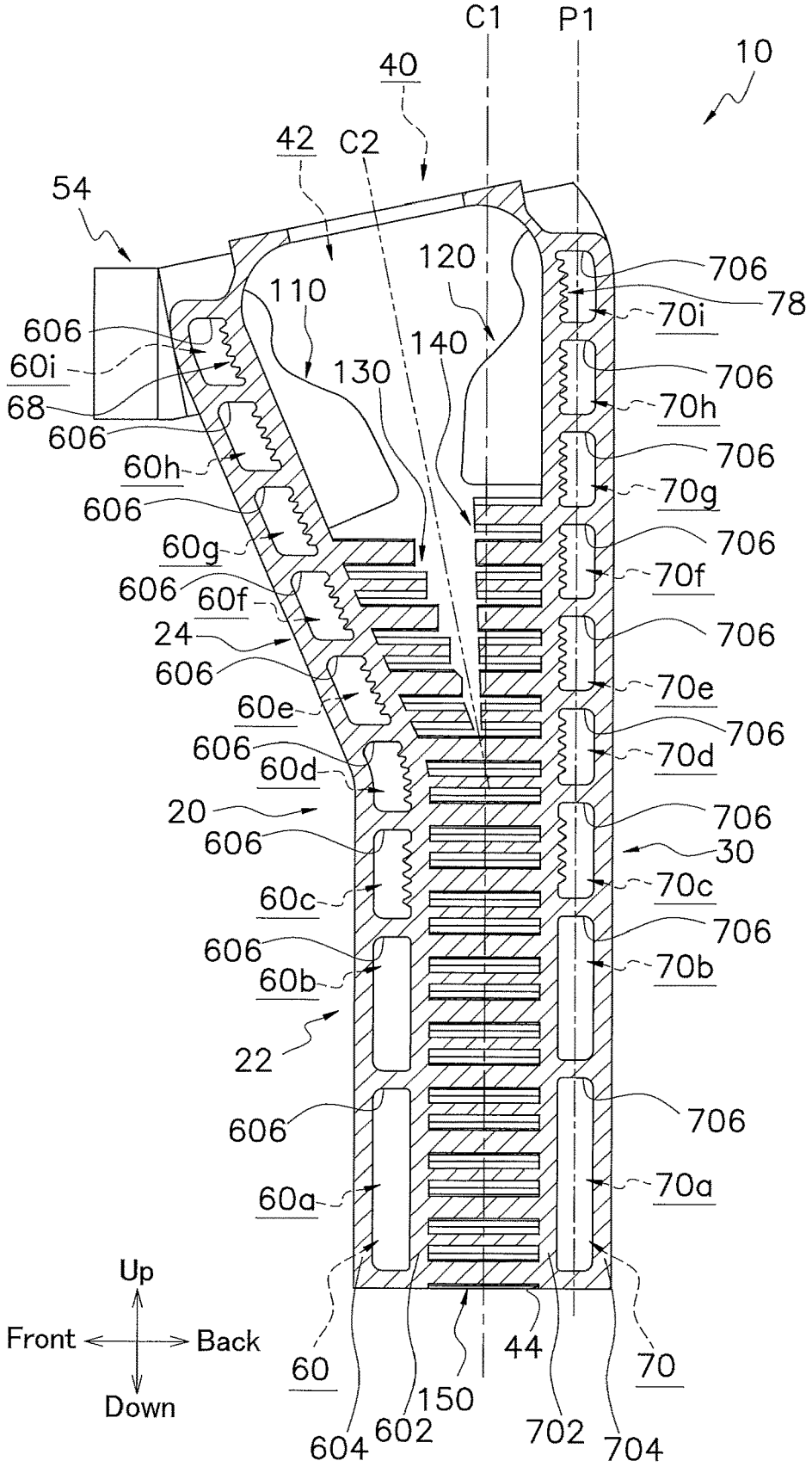
FIG. 5 is a cross section view of the heat exchanger viewing from the arrow direction of the V-V line of FIG. 4.

The heat exchanger 10 has a flue gas space 40 including the combustion space 42 and two channels 60, 70 as shown in FIG. 5. The heat exchanger 10 is configured such that the medium fluid in the two channels 60, 70 can exchange heat with the flue gas flowing in the flue gas space 40, in use.

As mentioned above, the burner port 3*a* of the burner 3 is arranged over the combustion space 42 and the flammable gas is combusted in the combustion space 42. Flue gas generated by the combustion of the flammable gas flows downward in the flue gas space 40.

The channels 60, 70 constitute a part of a medium fluid circuit 5 in which a medium fluid circulates. The medium fluid circuit 5 further includes an inlet pipe 5*b*, an outlet pipe 5*c*, and the medium fluid inlet/outlet pipes (not shown) which are arranged outside the heat exchange system 1 and are connected to the medium fluid water inlet/outlet connectors 9*c*, 9*d*. The medium fluid circuit 5 also includes space heating devices (not shown), such as floor heating devices and radiators, which are arranged outside the heat exchange system 1 and which are connected to the medium fluid outlet pipe and the medium fluid inlet pipe. For example, the medium fluid circulating in the medium fluid circuit 5 is an aqueous medium.

In the medium fluid circuit 5, the medium fluid is supplied to the medium fluid inlet connector 9*c* from the medium fluid inlet pipe (not shown). The medium fluid then flows in each of the channels 60, 70 from the inlet of each of the channels 60, 70 through the inlet pipe 5*b*. On the inlet pipe 5*b*, the pump 5*a* is arranged to circulate the medium fluid in the medium fluid circuit 5. In the heat exchanger 10, the medium fluid flows in the channels 60, 70 and exchanges heat with the flue gas flowing in the flue gas space 40. After passing through the channels 60, 70, the medium fluid in each of the channels 60, 70 flows out from an outlet of each of the channels 60, 70. The medium fluid then flows out to the medium fluid outlet pipe (not shown) through the outlet pipe 5*c* and the medium fluid outlet connector 9*d* and is sent to space heating devices (not shown) through the medium fluid outlet pipe.

The configuration of the heat exchanger 10 will be explained in detail later.

After the flue gas has passed through the flue gas space 40, the flue gas is exhausted out of the housing 9 though a gas duct 8. Condensate from the flue gas is corrected at a drain collecting part 4 located below the heat exchanger 10. The drain collecting part 4 includes a drain pipe 4*a*. The end portion of the drain pipe 4*a* is connected to the siphon 4*b*. The siphon 4*b* allows the condensate from the flue gas to drain to the drain outlet pipe (not shown) which is connected to the condensate outlet connector 9*b* while preventing the release of the flue gas.

The medium fluid circuit 5 includes a connecting pipe 5*d* which connects the inlet pipe 5*b* and the outlet pipe 5*c* of the medium fluid circuit 5 via a medium fluid channel 6*a* formed in the heat exchanger 6. The connecting pipe 5*d* is configured so that the medium fluid can flow from the outlet pipe 5*c* to the inlet pipe 5*b* through the medium fluid channel 6*a*.

The heat exchanger 6 also has a domestic water channel 6*b* formed therein. An inlet pipe 7*a* of the domestic water is connected to an inlet of the domestic water channel 6*b*. An outlet pipe 7*b* of the domestic water is connected to an outlet of the domestic water channel 6*b*. The inlet pipe 7*a* of the domestic water is connected to DHW inlet connector 9*e*. The outlet pipe 7*b* of the domestic water is connected to DHW outlet connector 9*f*. The inlet/outlet pipes 7*a*, 7*b* of the domestic water are configured so that domestic water flows in the domestic water channel 6*b* from the inlet of the domestic water channel 6*b*, and flows out to the outlet pipe 7*b* from the outlet of the domestic water channel 6*b* after the domestic heat water passes through the domestic water channel 6*b*. In the heat exchanger 6, domestic heat water flowing in domestic water channel 6*b* exchanges heat with the medium fluid flowing through the medium fluid channel 6*a*, in use.

The operation of the heat exchange system 1 is briefly explained.

Fuel gas is supplied via the gas inlet connector 9*a*. Fuel gas and air taken from the outside of the housing 9 are mixed. The mixture gas is supplied to the burner 3. The flammable gas (mixture gas) is injected into the combustion space 42 from the burner 3 and is combusted in the combustion space 42. Flue gas then flows downwardly in the flue gas space 40.

Medium fluid is circulated in the medium fluid circuit 5. During circulation, relatively low temperature medium fluid flows into the channels 60, 70 via medium fluid inlet connector 9*c* and the inlet pipe 5*b*. Medium fluid flowing in the channels 60, 70 exchanges heat with the flue gas in the flue gas space 40 in use. The medium fluid heated at the heat exchanger 10 flows out from the medium fluid outlet connector 9*d* through the outlet pipe 5*c* and is sent to the space heating devices (not shown). The heat of the medium fluid is used for the space heating devices and cooled medium fluid (the medium fluid taken its heat by the space heating devices) then returns to the heat exchange system 1. By changing the direction of the flowing direction of the medium fluid, the medium fluid heated at the heat exchanger 10 is sent to the heat exchanger 6 to heat the domestic water. The heated domestic water is sent to the usage point such as bath room and kitchen.

The flue gas flowing out of the flue gas space 40 is exhausted through the gas duct 8. The condensate from the flue gas is drained to the drain outlet pipe through the siphon 4*b*.

A heat exchanger 10 according to a preferred embodiment of the present invention will be described in detail.

Figure 2:
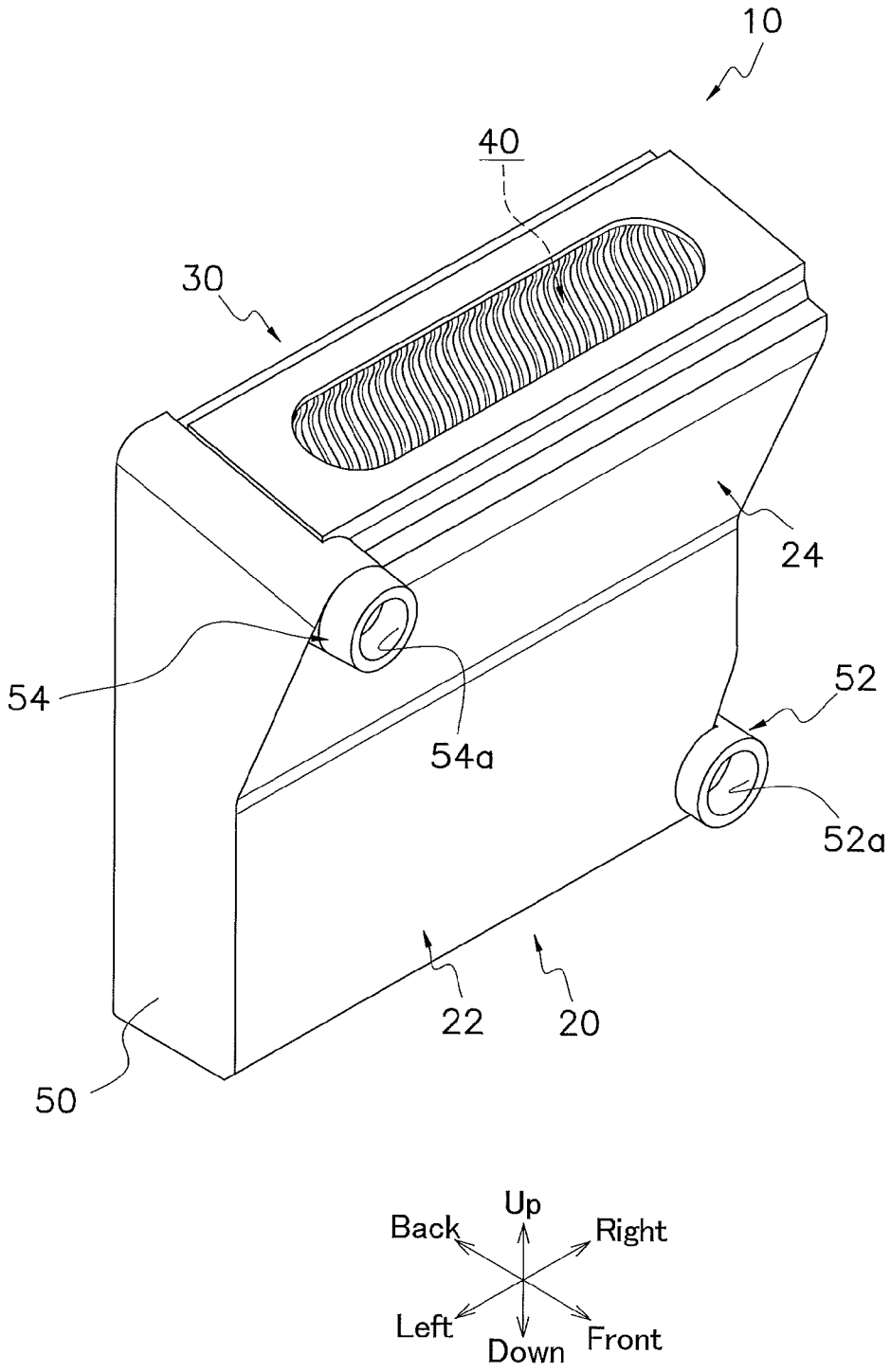
FIG. 2 is a perspective view of the heat exchanger according to FIG. 1.
Figure 4:
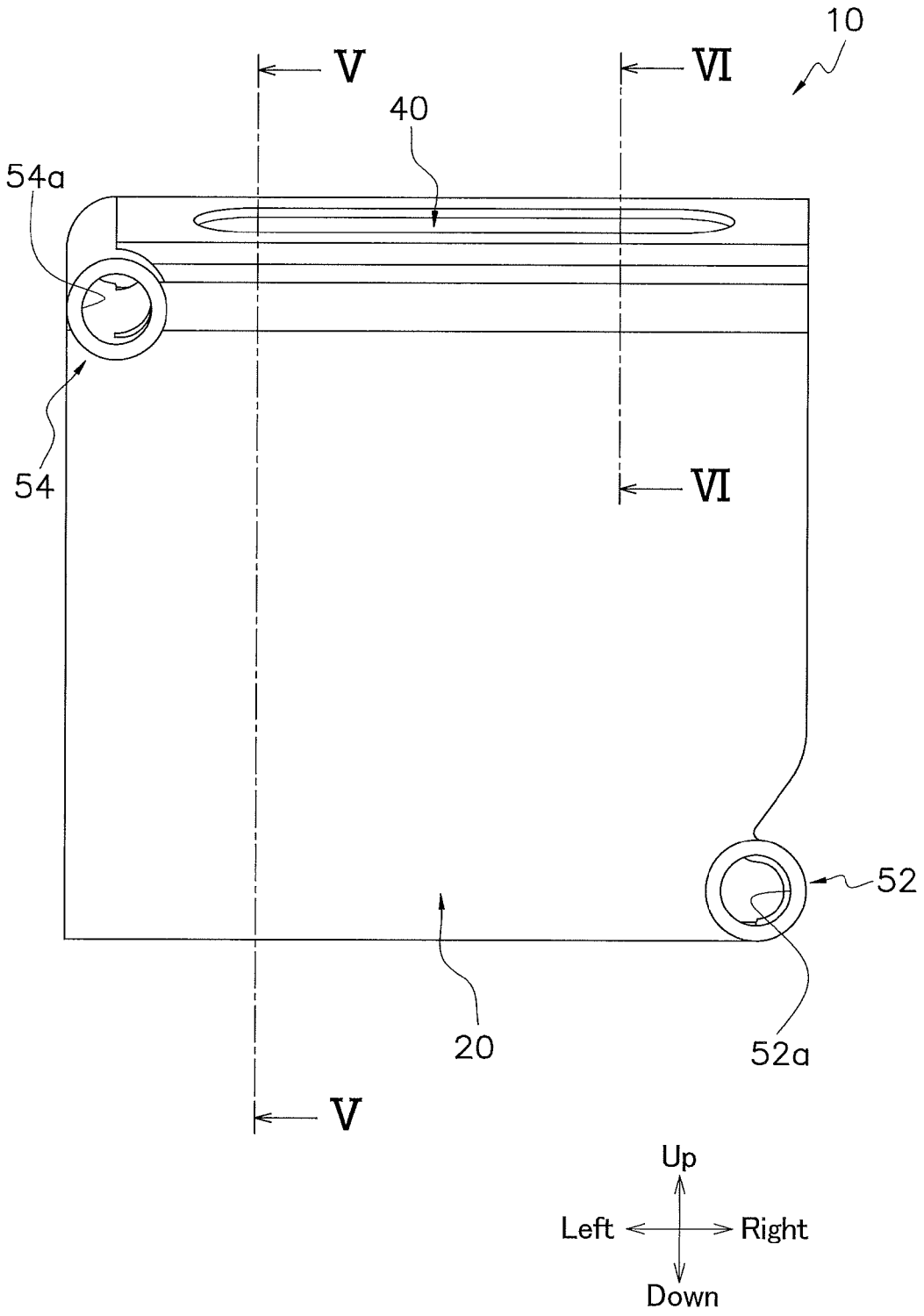
FIG. 4 is a front view of the heat exchanger according to FIG. 1.

FIG. 2 shows a perspective view of the heat exchanger 10. FIG. 3 shows a side view of the heat exchanger 10 on which the burner is mounted. FIG. 4 shows a front view of the heat exchanger 10.

The heat exchanger 10 is preferably manufactured by corrosion resistant metal such as aluminum alloy. For example, heat exchanger 10 is manufactured as monoblock sand-cast, although manufacturing method is not limited to this. The heat exchanger 10 is designed so that the burner 3 is mounted on the top of the heat exchanger 10 as shown in FIG. 3.

The heat exchanger 10 mainly includes a front wall 20, a back wall 30, side walls 50, an inlet distribution pipe 52, and an outlet converging pipe 54 as shown in FIG. 2.

The front wall 20 and the back wall 30 form a flue gas space 40 for a flue gas. The flue gas space 40 is formed by a space defined by the front wall 20, the back wall 30 and the side walls 50 which are attached to lateral ends of the front wall 20 and the back wall 30. The flue gas space 40 includes the combustion space 42 of the flammable gas. The combustion space 42, in which the burner port 3*a* of the burner 3 is installed, is arranged at the upper part of the flue gas space 40 as shown in FIG. 5. The flue gas flows downwardly in the flue gas space 40 from the combustion space 42 and flows out from an opening 44 arranged at the bottom of the heat exchanger 10, in use.

A front channel 60 is formed in the front wall 20 and a back channel 70 is formed in the back wall 30 as shown in FIG. 5. The medium fluid flows in the front channel 60 and back channel 70, in use.

The inlet distribution pipe 52 has a tube-shape which has an inlet opening 52*a* in the front side as shown in FIG. 4. The inlet pipe 5*b* of the medium fluid circuit 5 is connected at the inlet opening 52*a*. The inlet distribution pipe 52 is also connected to the inlets of each of the front channel 60 and the back channel 70. The inlet distribution pipe 52 is configured to distribute the fluid to the front channel 60 and the back channel 70, in use. The medium fluid flows into the front channel 60 and the back channel 70 through the inlet distribution pipe 52, in use.

The outlet converging pipe 54 has a tube-shape which has an outlet opening 54*a* in the front side as shown in FIG. 4. The outlet pipe 5*c* of the medium fluid circuit 5 is connected at the outlet opening 54*a*. The outlet converging pipe 54 is also connected to the outlets of each of the front channel 60 and the back channel 70. The outlet converging pipe 54 is configured to converge the fluid from the front channel 60 and the back channel 70, and output therefrom, in use. The converged medium fluid flows in the outlet pipe 5*c* of the medium fluid circuit 5, in use.

Now, the back wall 30 and the front wall 20 will be described in more detail.

The back wall 30 has a tabular shape. The back wall 30 extends along a first plane P1 as shown in FIG. 5. The heat exchanger 10 is arranged on a horizontal plane and the first plane P1 is a vertical plane in this embodiment, although the arrangement of the heat exchanger 10 is not limited to this. In the heat exchange system 1, the heat exchanger 10 is preferably accommodated such that the back wall 30 extends along one of the walls of the housing 9. Due to the shape of the back wall 30, a dead space between the back surface of the heat exchanger 10 and the inner surface of the wall of the housing 9 can be minimized.

The front wall 20 includes a lower portion 22 and an upper portion 24 as shown in FIG. 2. The lower portion 22 extends upwardly along the back wall 30 as shown in FIG. 3. In other word, the lower portion 22 of the frond wall extends in parallel with the back wall 30. The lower portion 22 preferably has a plane-like shape. The upper portion 24 extends upwardly from the upper end of the lower portion 22 as shown in FIG. 3. More specifically, the upper portion 24 extends upwardly from the upper end of the lower portion 22 in a planar fashion. The upper portion 24 of the front wall 20 has a plane-like shape. Furthermore, the upper portion 24 extends outwardly away from the back wall 30 so as to form a combustion space 42 of a flammable gas between the upper portion 24 of the front wall 20 and the back wall 30. The length L2 of the upper portion 24 along the longitudinal direction thereof is preferably longer than the length L1 of the lower portion 22 along the longitudinal direction thereof as shown in FIG. 3. Each of the longitudinal direction of the upper portion 24 and the lower portion 22 is a direction along which each of the upper portion 24 and the lower portion 22 extends in side view.

The space formed under the upper portion 24 is effectively used for arranging elements of the heat exchange system 1 such as the fan 2*a* to achieve the downsizing of the housing 9 of the heat exchange system 1 as shown in FIG. 3. The space formed under the upper portion 24 may also be used for arranging the other elements of the heat exchange system 1 such as valve, pipe, and venturi device.

Figure 7:
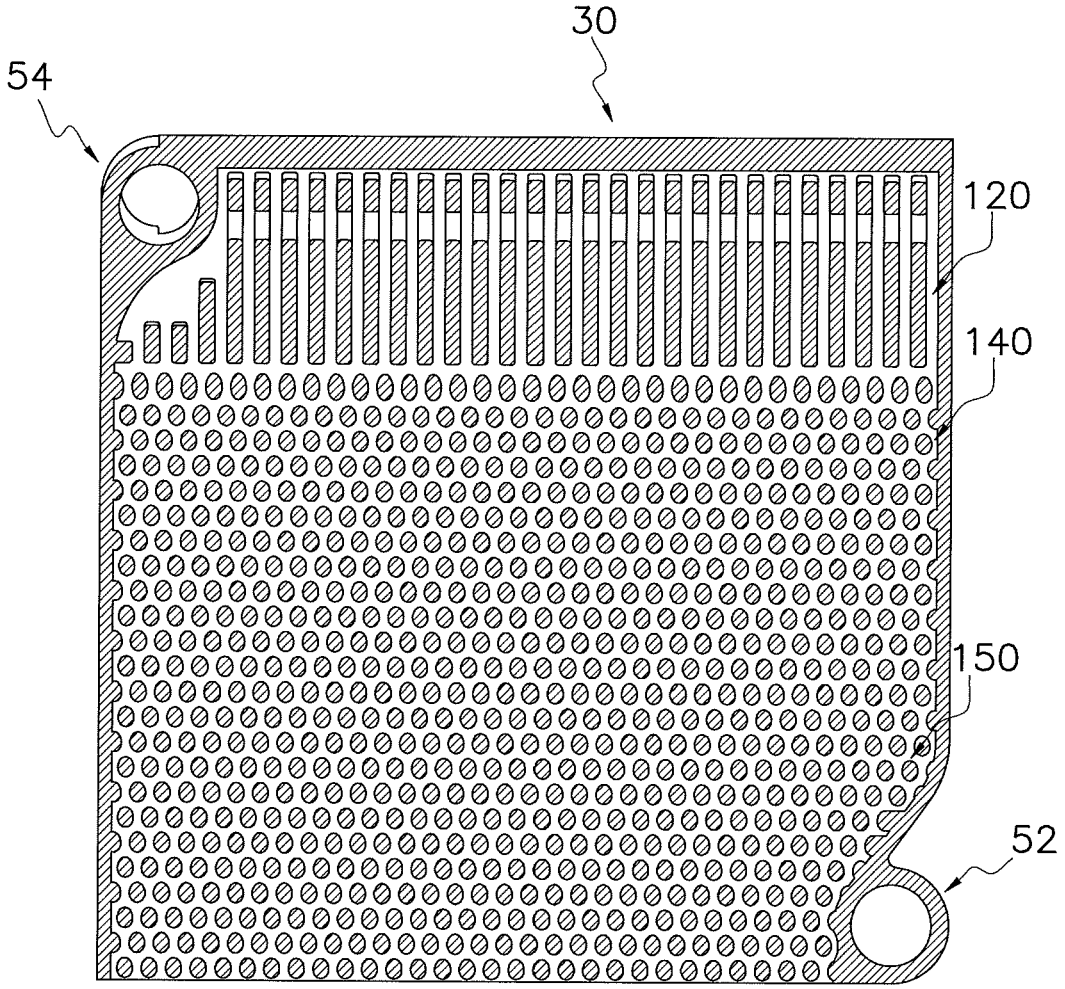
FIG. 7 is a cross section view of the heat exchanger viewing from the arrow direction of the VII-VII line of FIG. 3.

Next, the structures which are arranged on the inner surface of the front wall 20 and the inner surface of the back wall 30 will be described with reference to FIG. 5 to FIG. 7. The inner surface of the upper portion 24 is a surface which faces the back wall 30. The inner surface of the back wall 30 is a surface which faces the front wall 20.

FIG. 5 is a cross section view of the heat exchanger viewing from the arrow direction of the V-V line of FIG. 4. FIG. 6 is a cross section view of the heat exchanger viewing from the arrow direction of the VI-VI line of FIG. 4. FIG. 7 is a cross section view of the heat exchanger viewing from the arrow direction of the VII-VII line of FIG. 3.

The upper portion 24 of the front wall 20 is provided with front fins 110 as shown in FIG. 5. The front fins 110 are formed to protrude from the inner surface of the front wall 20. A plurality of the front fins 110 is arranged along the lateral direction (left-right direction) of the front wall 20 on the inner surface of the upper portion 24 at a predetermined interval. The number of the front fins 110 and the interval between the front fins 110 depend on the various factors such as the amount of heat transferred from the flue gas to the medium fluid, materials of the walls, and the power of the burner to be installed.

In addition to the front fins 110, the front wall 20 is provided with front pins 130, 150 as shown in FIG. 5. The front pins 130, 150 are arranged on the downstream side of the front fins 110 with respect to the flue gas flow direction. In other words, the front pins 130, 150 are arranged below the front fins 110. The cross-sectional of the front pins 130, 150 with respect to its main axis has a circular shape, or preferably an elliptic shape which is longer in the longitudinal direction than the lateral direction of the front wall.

Each of the pins 130, 150 has larger surface area per unit volume than the front fins 110. The front pins 130, 150 extend backwardly from the inner surface of the front wall 20. A part of the front pins (pins 130) is arranged at the upper portion 24 of the front wall 20 below the front fins 110. A plurality of the front pins 130 is preferably arranged along the lateral direction (left-right direction) of the front wall 20 on the inner surface of the upper portion 24 at a predetermined interval. Several lines of the front pins 130 are preferably arranged at the upper portion 24 along the longitudinal direction at a predetermined interval. The rest of the front pins 150 are arranged at the lower portion 22 of the front wall. A plurality of the front pins 150 is arranged along the lateral direction (left-right direction) of the front wall 20 on the inner surface of the lower portion 22 at a predetermined interval. Several lines of the front pins 150 are arranged at the lower portion 22 along the longitudinal direction at a predetermined interval. The number of the front pins 130, 150, and the interval between the front pins 130, 150 depend on the various factors such as the amount of heat transferred from the flue gas to the medium fluid, materials of the walls, and the power of the burner to be installed.

The back wall 30 is provided with back fins 120 as shown in FIG. 5. The back fins 120 are formed to protrude from the inner surface of the back wall 30. A plurality of the back fins 120 is arranged along the lateral direction (left-right direction) of the back wall 30 on the inner surface of the back wall 30 at a predetermined interval as shown in FIG. 7. The number of the back fins 120 and the interval between the back fins 120 depend on the various factors such as the amount of heat transferred from the flue gas to the medium fluid, materials of the walls, and the power of the burner to be installed.

The number of the back fins 120 and the interval between the back fins 120 are preferably the same as those of the front fins 110. Each of the back fins 120 preferably corresponds to one of the front fins 110 such that the corresponding front and back fins face to each other. The front fin 110 and the corresponding back fin 120 are arranged symmetrically with respect to a virtual line C2 along which the flammable gas is to be injected into the combustion space 42 as shown in FIG. 5.

The shapes of the front fins 110 and the back fins 120 are described in detail with reference to FIG. 6.

Most of the front fins 110 and the corresponding back fins 120, except for fins 110, 120 arrange under the outlet converging pipe 54 (refer to FIG. 7), include respectively a first portion 112, 122 and a second portion 114, 124 arranged below the first portion 112, 122 as shown in FIG. 6. The height H1 of the first portion 112, 122 from the inner surface of the corresponding wall 20, 30 is smaller than the height H2 of the second portion 114, 124 from the inner surface of the corresponding wall 20, 30 as shown in FIG. 6.

Preferably, each of the fins 110, 120 includes the first portion 112, 122 and the second portion 114, 124.

Most of the front fins 110 and the corresponding back fins 120, except for fins 110, 120 arrange under the outlet converging pipe 54 (refer to FIG. 7), include an inwardly bulged portion 112*a*, 122*a* which bulges toward the virtual line C2 and an outwardly curved portion 112*b*, 122*b* which curves away from the virtual line C2 as shown in FIG. 6. The outwardly curved portion 112*b*, 122*b* is arranged below the inwardly bulged portion 112*a*, 122*a* as shown in FIG. 6.

The inwardly bulged portion 112*a*, 122*a* and the outwardly curved portion 112*b*, 122*b* are formed so as to keep a predetermined distance between the burner 3, more specifically the burner port 3*a* of the burner 3, to be installed on the heat exchanger 10 and the fin 110, 120. The predetermined distance depends on various factors such as the desired power of the burner 3 and the material of the fins 110, 120.

Preferably, each of the fins 110, 120 includes the inwardly bulged portion 112*a*, 122*a* and the outwardly curved portion 112*b*, 122*b*.

Each of the most of the front fins 110 and the corresponding back fins 120, except for fins 110, 120 arranged under the converging pipe 54 (refer to FIG. 7), has a tapered portion 112*c*, 122*c* where the height of the fin 110, 120 from the inner surface of the corresponding wall 20, 30 gradually decreases towards an upper end of the fin 110, 120 as shown in FIG. 6.

The tapered portion 112*c*, 122*c* is formed so as to keep a predetermined distance between the burner 3, more specifically the burner port 3*a* of the burner 3, to be installed in the heat exchanger 10 and the fin 110, 120. The predetermined distance depends on various factors such as the desired power of the burner 3 and the material of the fins 110, 120.

Preferably, each of the fins 110, 120 has the tapered portion 112*c*, 122*c*.

In addition to the back fins 120, the back wall 30 is provided with back pins 140, 150 as shown in FIG. 5. The cross-sectional of the back pins 140, 150 with respect to its main axis has a circular shape, or preferably an elliptic shape which is longer in the longitudinal direction than the lateral direction of the back wall 30. Each of the pins 140, 150 has larger surface area per unit volume than the back fins 120.

The back pins 140, 150 extend forwardly from the inner surface of the back wall 30. A plurality of the back pins 140, 150 is arranged in the lateral direction (left-right direction) of the back wall 30 on the inner surface of the back wall 30 at a predetermined interval. Several lines of the back pins 140, 150 are arranged on the back wall 30 along the longitudinal direction at a predetermined interval. The number of the back pins 140, 150 and the interval between the back pins 140, 150 depend on the various factors such as the amount of heat transferred from the flue gas to the medium fluid, materials of the walls, and the power of the burner to be installed.

The front pins 150 arranged at the lower portion 22 of the front wall 20 are preferably connected to the corresponding back pins 150. In this embodiment, each of the pins 150 extends from the front wall 20 to the back wall 30. In other words, front pins 150 arranged at the lower portion 22 of the front wall 20 are integrated with the back pins 150.

The front pins 130 arranged at the upper portion 24 of the front wall 20 so as to face to the corresponding back pins 140. In other words the front pins 130 are arranged at the upper portion 24 of the front wall 20 is not connected to the corresponding the back pins 140 so as to make a space between them.

As explained above, the upper portion of the front wall 20 and the corresponding part of the back wall 30, which forms the combustion space 42 of heat exchanger 10 therebetween, is designed symmetrically with respect to the virtual line C2 which tilts against a virtual line C1. The lower portion 22 of the front wall 20 and the back wall 30 is arranged symmetrical with respect to the virtual line C1. With this configuration, flammable gas can be combusted under proper condition and the concentration of CO and NOx contained in the emission gas can be lowered.

Next, the front channel 60 formed in the front wall 20 and the back channel 70 formed in the back wall 30 will be described in detail with reference to FIG. 5 and FIG. 8. FIG.

8 is a cross section view of the heat exchanger viewing from the arrow direction of the VIII-VIII line of FIG. 3.

The front wall 20 has an inside wall 602 and an outside wall 604 which face to each other and form the front channel 60 therebetween. The front wall 20 also has wall elements 606 which connect the inside wall 602 and the outside wall 604 and define the front channel 60. The back wall 30 has an inside wall 702 and an outside wall 704 which face to each other and form the back channel 70 therebetween. The back wall 30 has wall elements 706 which connect the inside wall 702 and outside wall 704 and define the back channel 70.

Figure 8:
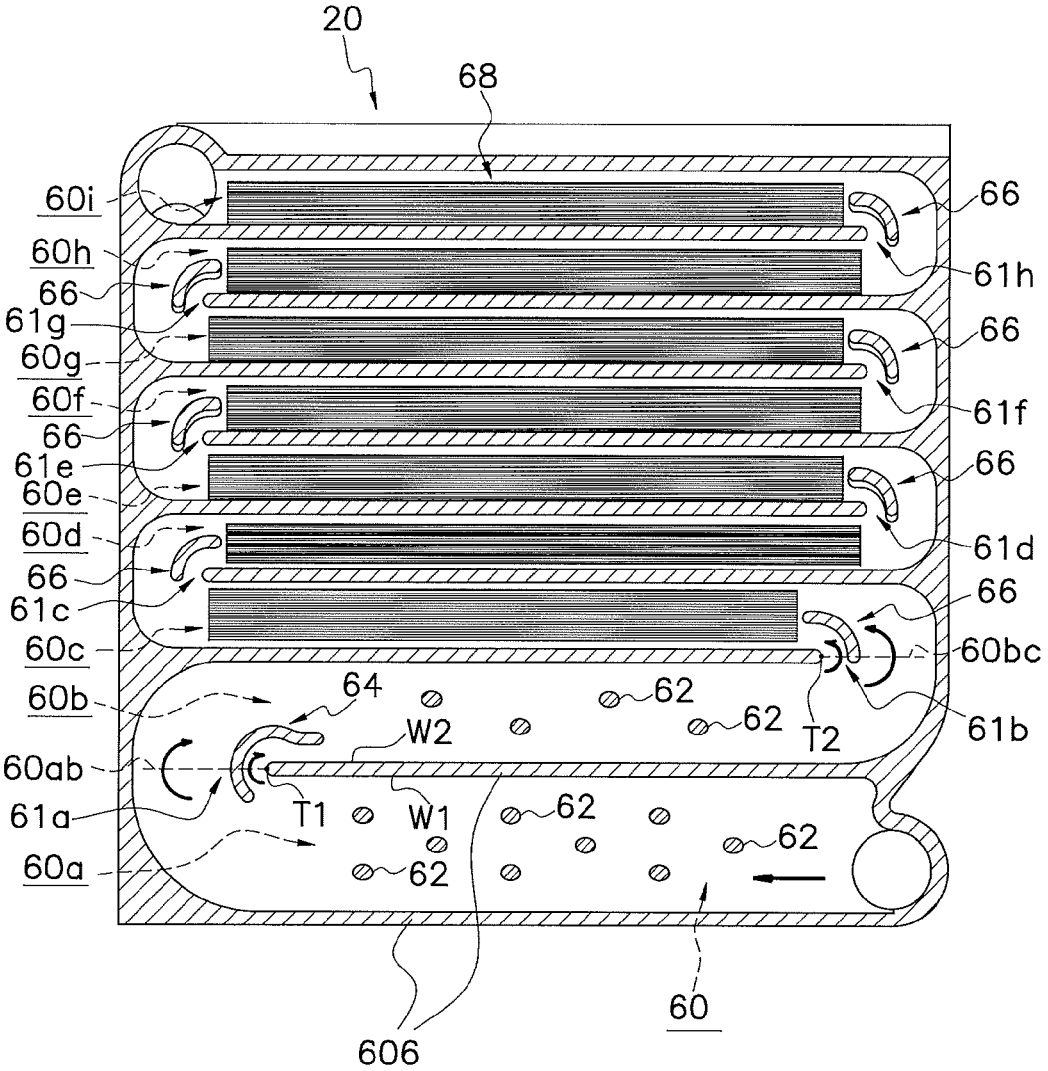
FIG. 8 is a cross section view of the heat exchanger viewing from the arrow direction of the VIII-VIII line of FIG. 3.

The front channel 60 includes straight portions 60*a*, 60*b*, 60*c*, 60*d*, 60*e*, 60*f*, 60*g*, 60*h*, and 60*i* which are arranged in substantially parallel to each other and are connected in series as shown in FIG. 8. The medium fluid supplied from the inlet of the front channel 60 flows the straight portions 60*a*, 60*b*, 60*c*, 60*d*, 60*e*, 60*f*, 60*g*, 60*h*, and 60*i* in this order and flows out from the outlet of the front channel 60. In this paragraph, parallel means that the two straight portions are connected with an angle such that the speed of the turning fluid in the channel drops to nearly zero on the inner side in the connecting area 61*a*, 61*b*, 61*c*, 61*d*, 61*e*, 61*f*, 61*g*, and 61*h*. For example, in the vicinity of an inner part T1 of a joint 60*ab* in the connected area 61*a* of the straight portions 60*a* and the straight portions 60*b*, the fluid nearly stops upon turning.

A plurality of pins 62 extending from the inside wall 602 is arranged in the straight portions 60*a*, 60*b* so as to improve the heat transfer efficiency between the medium fluid flowing in the straight portions 60*a*, 60*b* and the flue gas which flows along the inside wall 602. The straight portions 60*a*, 60*b* require higher strength against burst than the straight portions 60*c*-60*i* since the straight portions 60*a*, 60*b* has the larger surface area compared with the straight portions 60*c*-60*i*. A plurality of pins 62 can also improve the strength against burst of the straight portions 60*a*, 60*b*. In the straight portions 60*c*-60*i*, a plurality of grooves 68 extending along the longitudinal direction of the straight portions 60*c*-60*i* is formed on the inside wall 602. Thereby the heat transfer area is increased between the medium fluid flowing in the straight portions 60*c*-60*i* and the flue gas which flows along the inside wall 602.

Preferably, the cross-sectional area of the straight portion 60*a* arranged on the most upstream side is larger than the cross-sectional area of the other straight portions 60*b*-60*i* arranged on downstream side with respect to the fluid flow as shown in FIG. 5.

The back channel 70 also includes straight portions 70*a*, 70*b*, 70*c*, 70*d*, 70*e*, 70*f*, 70*g*, 70*h*, and 70*i* as shown in FIG. 5. The straight portions 70*a*-70*i* are arranged in substantially parallel to each other and are connected in series. The medium fluid flowing from the inlet of the back channel 70 flows the straight portions 70*a*, 70*b*, 70*c*, 70*d*, 70*e*, 70*f*, 70*g*, 70*h*, and 70*i* in this order and flows out from the outlet of the back channel 70. In this paragraph, parallel has the same meaning with the previous paragraph for the front channel 60. In a manner similar to the above, a plurality of pins (not shown) extending from the inside wall 702 is arranged in the straight portions 70*a*, 70*b* and a plurality of grooves 78 extending along the longitudinal direction of the straight portions 70*c*-70*i* are formed on the inside wall 702 in the straight portions 70*c*-70*i*. The cross-sectional area of the straight portion 70*a* arranged on the most upstream side is larger than the cross-sectional area of the other straight portions 70*b*-70*i* arranged on downstream side with respect to the fluid flow.

The front channel 60 is further explained with reference to FIG. 8.

In the front channel 60, stagnation prevention means 64, 66 are preferably arranged in each of the connecting area 61*a*-61*h* of the straight portions 60*a*-60*i* as shown in FIG. 8. The stagnation prevention means 64, 66 connects the inside wall 602 and the outside wall 604 of the front wall 20.

In this embodiment, stagnation prevention means 64, 66 are arranged in each of the connecting area 61*a*-61*h* of the straight portions 60*a*-60*i*, but it is not limited to this configuration. It is preferable that at least the first stagnation prevention means 64 is arranged in the connecting area 61*a* of the straight portions 60*a* and the straight portion 60*b* which locates on the most upstream side in the channel 60 with respect to a fluid flow.

The first stagnation prevention means 64 is arranged in the connecting area 61*a* of the straight portions 60*a* and the straight portion 60*b* which locates on the most upstream side in the channel 60 with respect to the fluid flow. The first stagnation prevention means 64 is arranged in the vicinity of the inner part T1 of the joint 60*ab* of the straight portions 60*a*, 60*b* around which the fluid is to turn as shown in FIG. 8. The first stagnation prevention means 64 is formed in a hook-like shape when seen from the direction perpendicular to the front wall 20 as shown in FIG. 8.

At least one or more second stagnation prevention means 66 are preferably arranged in the connecting area 61*b*-61*h* of the straight portions 60*b*-60*i* in the channel 60. In other words, the second stagnation prevention means 66 are arranged in the connecting areas other than the connecting area 61*a* which locates on the most upstream side in the channel 60 with respect to the fluid flow. The second stagnation prevention means 66 are formed in an arc-like shape when seen from the direction perpendicular to the front wall 20 as shown in FIG. 8. The arc-like shaped second stagnation prevention means 66 are arranged in the front channel 60 such that the arc-like shaped surface is substantially along the fluid flow.

Each of the second stagnation prevention means 66 is arranged in the vicinity of an inner part of a joint of the straight portions 60*b*-60*i* around which the fluid is to turn. For example, one of the second stagnation prevention means 66 is arranged in the vicinity of an inner part T2 of a joint 60*bc* of the straight portions 60*b*, 60*c* around which the fluid is to turn as shown in FIG. 8.

The first stagnation prevention means 64 is arranged so as to partially surround the inner part T1 of the joint 60*ab* of the straight portions 60*a*, 60*b* around which the fluid is to turn when seen from the direction perpendicular to the wall 20 as shown in FIG. 8. Specifically the first stagnation prevention means 64 is preferably arranged so as to surround the inner part T1 of the joint 60*ab* of the straight portions 60*a*, 60*b* over an angle range of more than 90 degrees, and more preferably over an angle range of more than 180 degrees when seen from the direction perpendicular to the wall 20 as shown in FIG. 8.

The one or more second stagnation prevention means 66 are also arranged so as to partially surround the inner part of the joint of the straight portions around which the fluid is to turn when seen from the direction perpendicular to the wall 20 as shown in FIG. 8. For example, the second stagnation prevention means 66 are arranged so as to partially surround the inner part T2 of the joint 60*bc* of the straight portions 60*b*, 60*c* around which the fluid is to turn when seen from the direction perpendicular to the wall 20 as shown in FIG. 8. The second stagnation prevention means 66 are arranged so as to surround the inner part T2 of the joint 60*bc* of the straight portions 60*b*, 60*c* over an angle range of more than 90 degrees when seen from the direction perpendicular to the wall 20.

Figure 9:
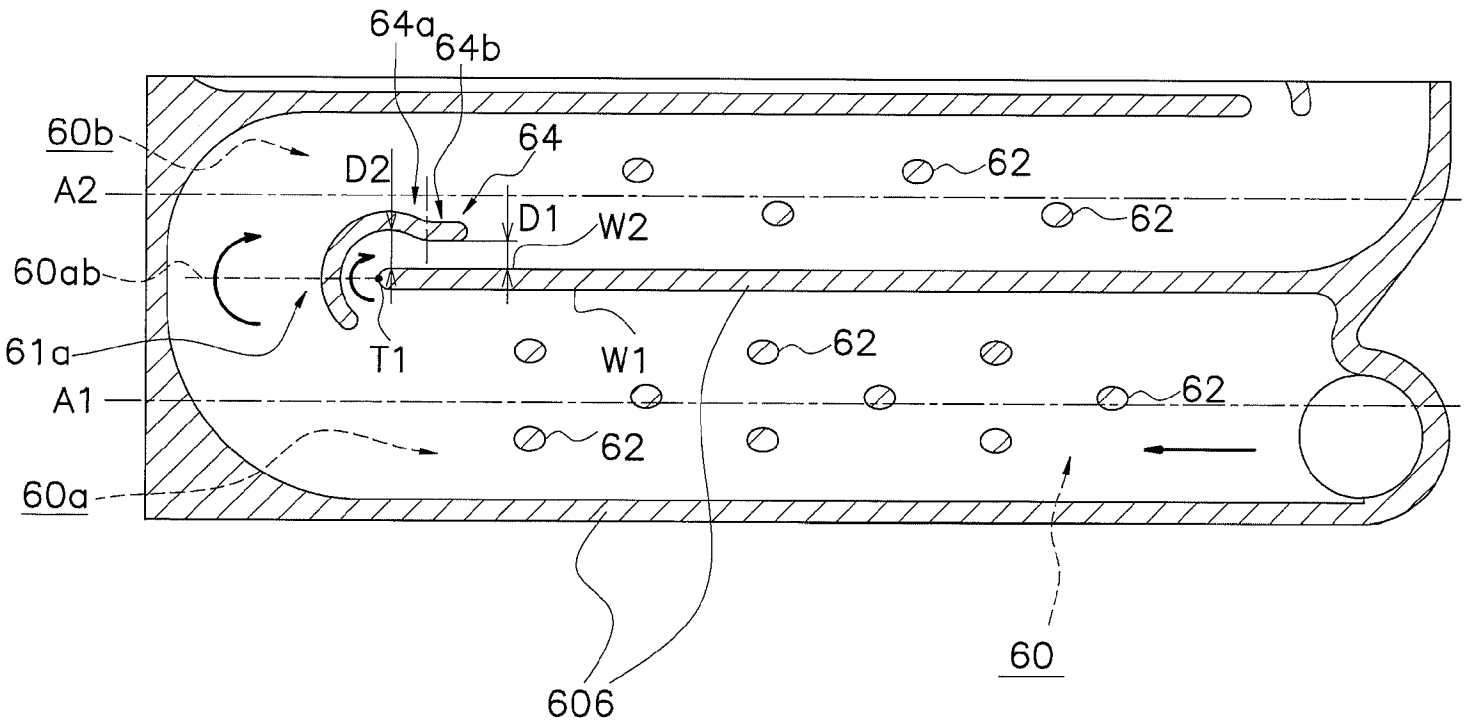
FIG. 9 is a partial enlarged view of FIG. 8.

The wall elements 606 which connects the inside wall 602 and the outside wall 604 include extending wall elements W1, W2 which respectively extend along the main axis A1, A2 of the straight portion 60*a*, 60*b*. The wall elements W1, W2 extend from the inner part T1 of the joint 60*ab* of the straight portions 60*a*, 60*b* around which the fluid is to turn as shown in FIG. 9. The main axes A1, A2 are axes along which the straight area of the straight portion 60*a*, 60*b* extends. The first stagnation prevention means 64 includes a first portion 64*a* which is arranged on the upstream side and a second portion 64*b* which is arranged on the downstream side with respect to the fluid flow as shown in FIG. 9. A maximum distance D1 between the second portion 64*b* and the extending wall element W2 is shorter than a maximum distance D2 between the first portion 64*a* and the extending wall element W2. The distance between the second portion 64*b* and the extending wall element W2 may be almost equal at any points.

The first stagnation prevention means 64 is arranged in the connecting area 61*a* in the straight portion 60*b* which is located on the downstream side among the two straight portions 60*a*, 60*b* connected. Each of the straight portions 60*a*, 60*b* has a straight area which has a straight tube-like shape. The first stagnation prevention means 64 is arranged to extend from the connecting area 61*a* into part of the straight area in the straight portion 60*b*. The first stagnation prevention means 64 may extend into the connecting area 61*a* located in the straight portion 60*a* at the upstream side with respect to the fluid flow.

The second stagnation prevention means 66 are arranged in the straight portion which is located at the downstream side with respect to the fluid flow among the straight portions connected. More specifically, the second stagnation prevention means 66 are arranged in the connecting area in the straight portion which is located on the downstream side among the two straight portions connected. Each of the straight portions 60*c*-60*i* has a straight area which has a straight tube-like shape. The second stagnation prevention means 66 may be arranged to extend from a connecting area into the straight area of the straight portion located on the downstream side.

The front channel 60 is explained above in detail with reference to FIG. 8. To avoid the redundancy of the explanation, the explanation of the back channel 70 is omitted regarding the common feature between the front channel 60 and the back channel 70. Only the difference between the front channel 60 and the back channel 70 will be explained below.

The heat transfers on the side of the front wall 20 and the side of the back wall 30 have different characteristic because of the unsymmetrical design of the walls. Specifically, the medium fluid in the front channel 60 of the front wall 20 can obtain more heat from the flue gas than the medium fluid in the back channel 70 of the back wall 30. However, the heat exchanger 10 is configured such that the temperature of the medium fluid at each outlet of each channel 60, 70 is substantially the same, in use.

The heat exchanger 10 is therefore configured such that the volume flow rate and/or mass flow rate of the fluid in the front channel 60 is greater than the back channel 70, in use. It is preferable that the heat exchanger 10 is configured such that at least the mass flow rate of the fluid in the front channel 60 is greater than the back channel 70, in use. Volume flow rate means the volume of fluid which passes per unit time. Mass flow rate means mass of a fluid which passes per unit of time. The volume flow rate and mass flow rate of the fluid in the front channel 60 is greater than the back channel 70 means that the average volume flow rate and average mass flow rate of the fluid in the front channel 60 is greater than the back channel 70. Average volume/mass flow rate means volume/mass flow over the entire front or back channel 60, 70. Volume/mass flow rate is generally measured at the inlet/outlet of each channel 60, 70.

To achieve this, the back channel 70 is configured to have a higher fluid resistance than the front channel 60.

Preferably, the minimum cross section in the back channel 70 is smaller than the minimum cross section in the front channel 60 with respect to cross sections intersecting with the direction of the fluid flow.

Preferably, an average cross-sectional area of the back channel 70 is smaller than the average cross-sectional area of the front channel 60 with respect to cross sections intersecting with the direction of the fluid flow.

The front channel 60 includes a plurality of the straight portions 60*a*-60*i* as front sub channels which are arranged in substantially parallel to each other and are connected in series. The back channel 70 includes a plurality of the straight portions 70*a*-70*i* as back sub channels which are arranged in substantially parallel to each other. The straight portions 70*a*-70*i* are connected in series, and each of which faces to one of the straight portions 60*a*-60*i*. With respect to cross sections intersecting with the direction of the fluid flow, at least one of the straight portions 70*a*-70*i* has a minimum cross section smaller than a minimum cross section of the corresponding straight portions 60*a*-60*i* and/or an average cross-sectional area smaller than an average cross-sectional area of the corresponding straight portions 60*a*-60*i*.

Preferably, each of the straight portions 70*a*-70*i* has a minimum cross section smaller than a minimum cross section of the corresponding straight portions 60*a*-60*i* and/or an average cross-sectional area smaller than an average cross-sectional area of the corresponding straight portions 60*a*-60*i*.

The volume of the entire back channel 70 is smaller than the volume of the entire front channel 60.

The present invention is not limited to the above described embodiments, and various variations and modifications may be possible without departing from the scope of the present invention.

The invention claimed is:

1. A heat exchanger comprising:

a front wall; and a back wall forming a flue gas space together with the front wall such that a fluid flowing through a channel formed in the front wall and back wall can exchange heat with flue gas in the flue gas space, in use, an entirety of the back wall extending along a first plane, and the back wall being provided with a back fin, the front wall including a lower portion extending upwardly along the back wall, and an upper portion extending upwardly from an upper end of the lower portion and outwardly away from the back wall to form a combustion space of a flammable gas between the upper portion and the back wall, and the upper portion being provided with a front fin, the front fin and the back fin being arranged symmetrically with respect to a virtual line along which the flammable gas is to be injected into the combustion space, the virtual line intersecting with the first plane, a distance between the upper portion of the front wall and the back wall continuously increasing in the upward direction, the front wall and the back wall being asymmetric relative to a center line of the heat exchanger that extends substantially parallel to the first plane, the front wall being provided with front pins, the front pins extending backwardly from an inner surface of the front wall, some of the front pins being arranged at the upper portion of the front wall below the front fin, a remainder of the front pins being arranged at the lower portion of the front wall, the back wall being provided with back pins extending forwardly from an inner surface of the back wall, and the front pins arranged at the lower portion being connected to the back pins disposed at corresponding locations.

2. The heat exchanger according to claim 1, wherein the front fin protrudes from an inner surface of the front wall and the back fin protrudes from an inner surface of the back wall.

3. The heat exchanger according to claim 1, wherein the front wall is provided with a plurality of the front fins and the back wall is provided with a plurality of the back fins respectively corresponding to the front fins, at least some of the front fins and corresponding back fins include respectively a first portion and a second portion arranged below the first portion, and a height of the first portion from an inner surface of the corresponding wall is smaller than a height of the second portion from an inner surface of the corresponding wall.

4. The heat exchanger according to claim 1, wherein the front wall is provided with a plurality of the front fins and the back wall is provided with a plurality of the back fins respectively corresponding to the front fins, at least some of the front fins and corresponding back fins include respectively an inwardly bulged portion that bulges toward the virtual line and an outwardly curved portion that curves away from the virtual line, and the outwardly curved portion is arranged below the inwardly bulged portion.

5. The heat exchanger according to claim 4, wherein the inwardly bulged portions and the outwardly curved portions are formed so as to keep a predetermined distance between a burner to be installed on the heat exchanger and the fin.

6. The heat exchanger according to claim 1, wherein the front wall is provided with a plurality of the front fins and the back wall is provided with a plurality of the back fins respectively corresponding to the front fins, at least some of the front fins and corresponding back fins have respectively tapered portions where a height of the fin from an inner surface of the corresponding wall gradually decreases towards an upper end of the fin.

7. The heat exchanger according to claim 1, wherein the front pins are arranged at the upper portion of the front wall so as to face back pins disposed at corresponding locations.

8. The heat exchanger according to claim 1, wherein the front pins arranged at the upper portion of the front wall are formed so as to decrease distances between the front pins and the back pins toward a downside.

9. The heat exchanger according to claim 1, wherein each pin has a larger surface area per unit volume than each fin.

10. The heat exchanger according to claim 2, wherein the front wall is provided with a plurality of the front fins and the back wall is provided with a plurality of the back fins respectively corresponding to the front fins, at least some of the front fins and corresponding back fins include respectively a first portion and a second portion arranged below the first portion, and a height of the first portion from the inner surface of the corresponding wall is smaller than a height of the second portion from the inner surface of the corresponding wall.

11. The heat exchanger according to claim 2, wherein the front wall is provided with a plurality of the front fins and the back wall is provided with a plurality of the back fins respectively corresponding to the front fins, at least some of the front fins and corresponding back fins include respectively an inwardly bulged portion that bulges toward the virtual line and an outwardly curved portion that curves away from the virtual line, and the outwardly curved portion is arranged below the inwardly bulged portion.

12. The heat exchanger according to claim 2, wherein the front wall is provided with a plurality of the front fins and the back wall is provided with a plurality of the back fins respectively corresponding to the front fins, at least some of the front fins and corresponding back fins have respectively tapered portions where a height of the fin from the inner surface of the corresponding wall gradually decreases towards an upper end of the fin.

13. The heat exchanger according to claim 3, wherein the front wall is provided with a plurality of the front fins and the back wall is provided with a plurality of the back fins respectively corresponding to the front fins, at least some of the front fins and corresponding back fins include respectively an inwardly bulged portion that bulges toward the virtual line and an outwardly curved portion that curves away from the virtual line, and the outwardly curved portion is arranged below the inwardly bulged portion.

14. The heat exchanger according to claim 3, wherein the front wall is provided with a plurality of the front fins and the back wall is provided with a plurality of the back fins respectively corresponding to the front fins, at least some of the front fins and corresponding back fins have respectively tapered portions where a height of the fin from the inner surface of the corresponding wall gradually decreases towards an upper end of the fin.

15. The heat exchanger according to claim 4, wherein the front wall is provided with a plurality of the front fins and the back wall is provided with a plurality of the back fins respectively corresponding to the front fins, at least some of the front fins and corresponding back fins have respectively tapered portions where a height of the fin from the inner surface of the corresponding wall gradually decreases towards an upper end of the fin.

* * * * *